US007540448B2

(12) United States Patent
Dedeken

(10) Patent No.: US 7,540,448 B2
(45) Date of Patent: Jun. 2, 2009

(54) CHUCK FOR ROLLER-CUTTING AND WINDING MACHINE

(75) Inventor: Ralf Dedeken, Wiehl (DE)

(73) Assignee: Kampf GmbH & Co. Maschinenfabrik, Wiehl (DE)

( * ) Notice: Subject to any disclaimer, the term of this patent is extended or adjusted under 35 U.S.C. 154(b) by 174 days.

(21) Appl. No.: 11/415,941

(22) Filed: May 2, 2006

(65) Prior Publication Data

US 2007/0040060 A1 Feb. 22, 2007

(30) Foreign Application Priority Data

May 6, 2005 (DE) ..... 10 2005 021 077

(51) Int. Cl.
*B65H 75/24* (2006.01)

(52) U.S. Cl. ..... 242/571.6; 242/571.7; 279/2.21

(58) Field of Classification Search ..... 242/571, 242/571.6, 571.7, 579, 600; 279/2.21, 2.22, 279/129, 2.19, 2.2, 35
See application file for complete search history.

(56) References Cited

U.S. PATENT DOCUMENTS

| | | | | | |
|---|---|---|---|---|---|
| 2,211,472 | A * | 8/1940 | Klein et al. | ..... | 242/571.6 |
| 3,007,652 | A * | 11/1961 | Heckman | ..... | 242/571.7 |
| 3,815,836 | A * | 6/1974 | Munnekehoff et al. | ... | 242/571.7 |
| 3,963,250 | A * | 6/1976 | Flagg | ..... | 279/2.01 |
| 3,993,317 | A * | 11/1976 | Flagg | ..... | 279/2.19 |
| 4,193,633 | A * | 3/1980 | Potter | ..... | 279/2.2 |
| 4,291,842 | A * | 9/1981 | Isoard | ..... | 242/571.6 |
| 4,339,094 | A * | 7/1982 | Thievessen et al. | ..... | 242/571.7 |
| 4,519,620 | A * | 5/1985 | Keith | ..... | 279/2.2 |
| 4,635,872 | A * | 1/1987 | Thievessen | ..... | 242/571.6 |
| 5,524,849 | A * | 6/1996 | Dorfel et al. | ..... | 242/571.6 |
| 6,367,733 | B1 * | 4/2002 | McLaughlin | ..... | 242/575.3 |
| 2004/0256518 | A1 * | 12/2004 | Hope | ..... | 242/571 |

FOREIGN PATENT DOCUMENTS

| | | |
|---|---|---|
| CH | 392193 | 5/1965 |
| DE | 7930223 | 10/1979 |
| GB | 1549370 | 8/1979 |

* cited by examiner

*Primary Examiner*—Peter M Cuomo
*Assistant Examiner*—Juan J Campos
(74) *Attorney, Agent, or Firm*—Andrew Wilford

(57) ABSTRACT

A core chuck for a web-winding machine has a drive shaft extending along an axis and having an outer periphery of polygonal shape seen axially and a hub having a central hole with a polygonal shape substantially complementary to the shaft and fittable with limited clearance over the shaft. A plurality of outwardly directed faces on the hub engage respective jaws and are angled such that relative rotation between the hub and the jaws radially displaces the jaws. A retaining screw extending along an axis of rotation of the shaft through the hub has a threaded shank seatable in the shaft and a head engageable axially in one direction with the hub. A cover disk axially fixed on the hub is formed on the axis with a hole of smaller diameter than the head of the screw. The screw head is captured axially between the disk and the hub.

1 Claim, 4 Drawing Sheets

CHUCK FOR ROLLER-CUTTING AND WINDING MACHINE

FIELD OF THE INVENTION

The invention regards a chuck for a roller-type slitting and winding machine and a roller-type slitting and winding machine with winding arms each pivotally carrying a respective chuck.

BACKGROUND OF THE INVENTION

It is known that roller-type slitting and winding machines serve for winding up continuous material, particularly plastic foils and metal foils. The material is wound on core sleeves that are held at both ends by core chucks inserted in the sleeve. Each chuck in turn is rotatably carried on a respective winding arm.

German 33 29 330 (U.S. Pat. No. 4,635,872) describes a chuck for winding core sleeves and that contains several chuck segments in the form of tube segments that are radially adjustable in a cage, arrayed around a shaft with an equilateral polygonal shape. Rotatable support elements provided between the shaft and the chuck segments serve to move the chuck segments radially outward into a holding position when torque is applied to the journal.

Roller-type slitting and winding machines have to be set up such that they can process core sleeves of different sizes. When the size is changed, the machines have to be adapted as quickly as possible to chucks of changed diameters.

OBJECT OF THE INVENTION

It is an object of the invention to provide a chuck that can be quickly changed, that ensures exact centered rotation even at high processing speeds of the roller-type slitting and winding machine, and that can automatically chuck and center core sleeves of slightly varying inner diameters.

SUMMARY OF THE INVENTION

The design of the chuck with a central support hub that has a hole with a polygonal hub shape makes it possible to simply slide the chuck on a shaft fastened to the winding arm with a corresponding shape and to fasten it thereto. Preferably polygonal shapes deriving from the form of an equilateral triangle are used both for the support hub and the shaft. The polygonal connection is advantageous since when torque is applied the clearance between the support hub and the shaft are eliminated by a slight turning movement and the chuck is perfectly centered on the shaft.

According to a preferred embodiment, the chuck is fastened to the shaft by means of a central retaining screw that extends through the polygonal hole in the support hub and is screwed into a threaded hole formed in the center of the shaft. Thus, the chuck can be easily detached from the shaft, as the retaining screw pushes the chuck axially off the shaft.

According to a further preferred embodiment, the support hub has a plurality of concavely curved outer faces and cylindrical rollers are mounted on the inner side of each chuck jaw such that they project radially inward, with the cylindrical rollers gliding or rolling on respective concave outer faces and thereby changing the distance of the chuck jaws to the turning center of the chuck. Preferably each chuck jaw has two cylindrical rollers that are spaced from each other and can angularly move on a respective outer face. The curve of the outer face is designed such that in case of a relative rotation all chuck jaws move radially through the same distance. Thus, the chucks are exactly centered when gripping.

According to a further advantageous embodiment of the invention, each chuck has an end plate on its outer side that on the one hand is mounted on the support hub such that it can turn limitedly and on the other hand is rotationally fixed to each chuck jaw. The rotationally connection between the end plate and the chuck jaws leads to the radial expansion of the latter when the end plate is turned by a core sleeve. Thus, radial expansion of the chuck jaws is also ensured when they do not abut the inner side of the core sleeves.

BRIEF DESCRIPTION OF THE DRAWING

In the following, the invention is to be further described by means of a preferred illustrated embodiment.

SPECIFIC DESCRIPTION

Figure 1:
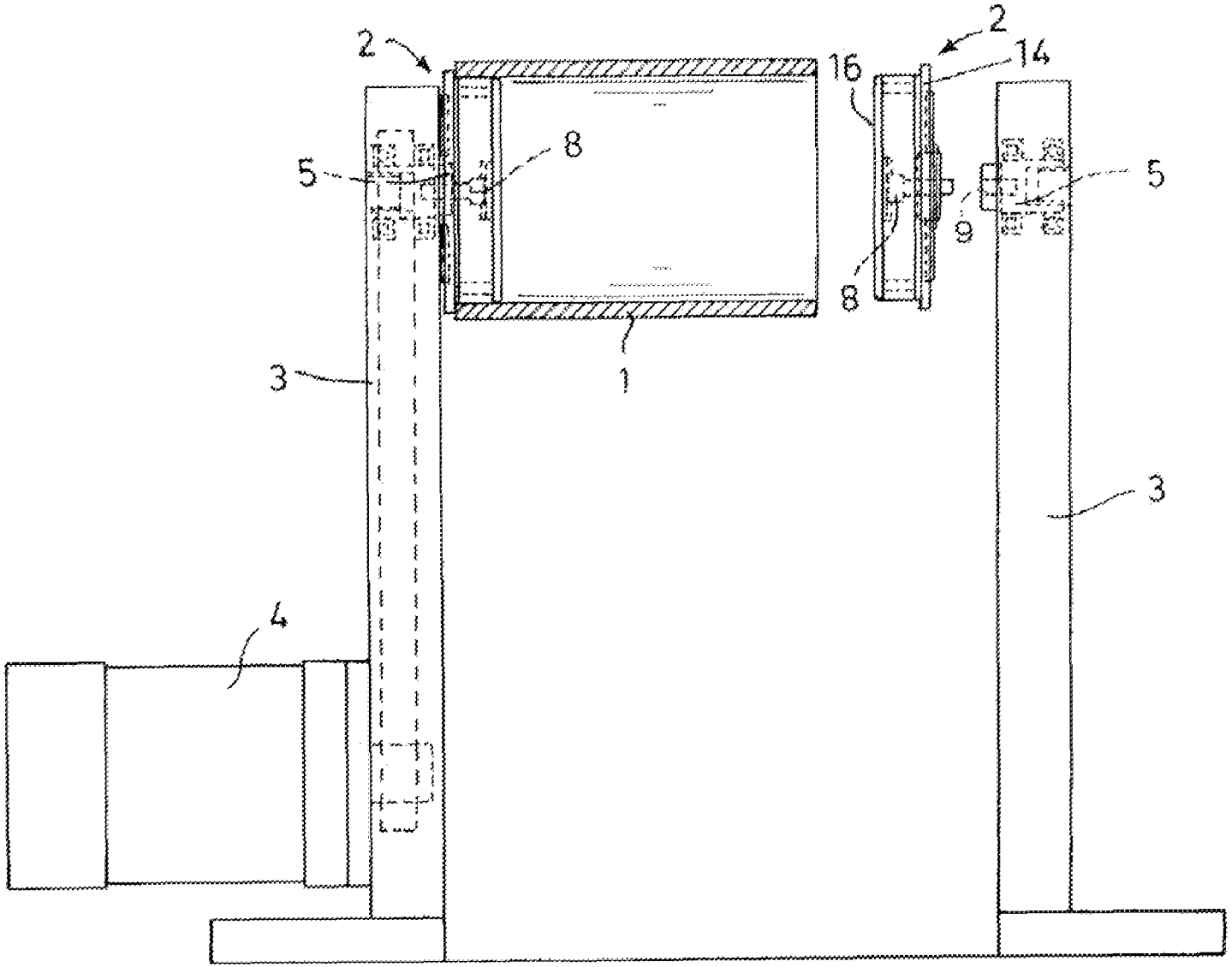
FIG. 1 shows a section of a roller-type slitting and winding machine crosswise to the travel direction of the material.
Figure 2:
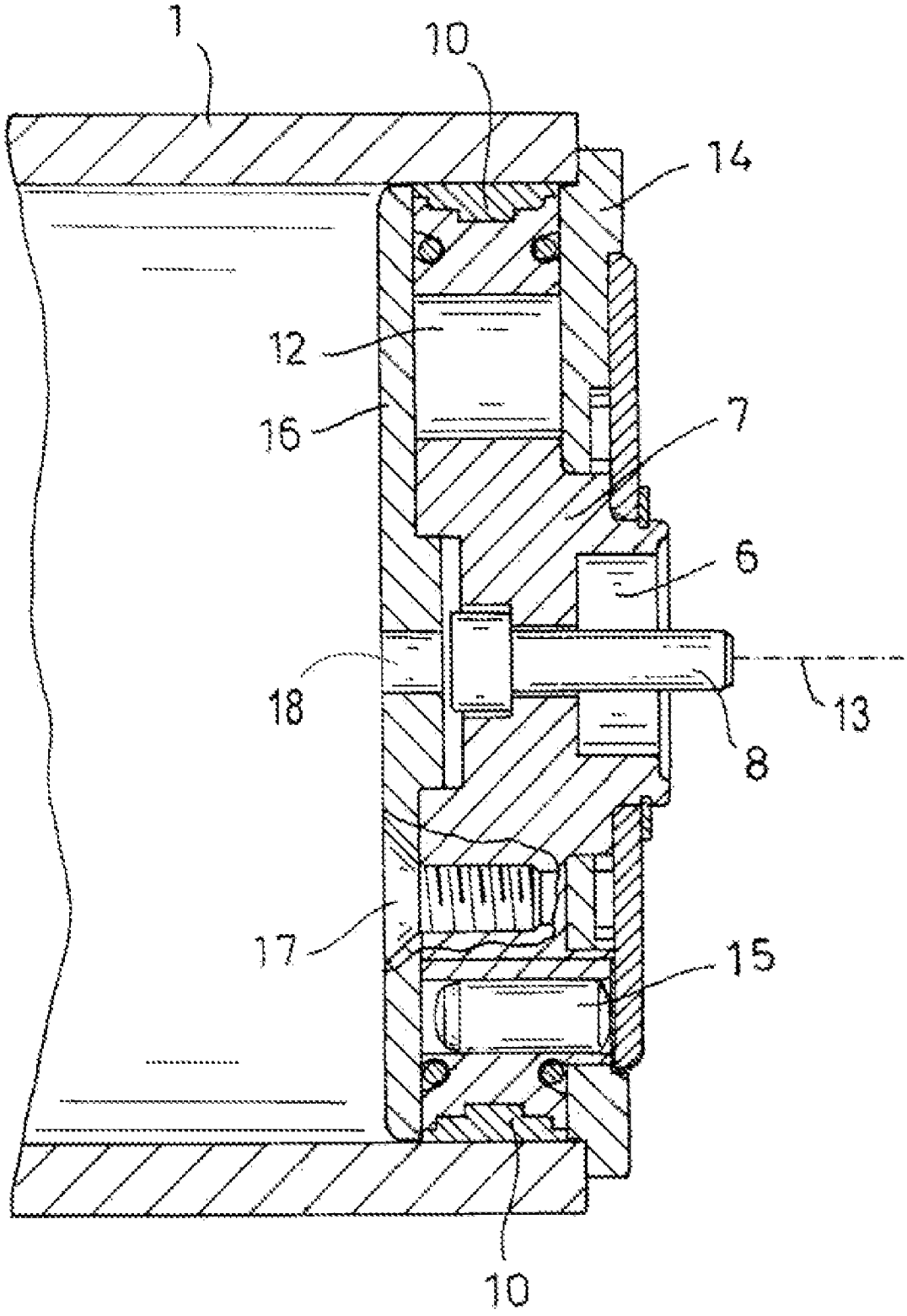
FIG. 2 shows a section through a chuck according to the invention.

The roller-type slitting and winding machine that is illustrated in section in FIG. 1 serves for winding continuous material, in particularly plastic metal foil, on sleeves. The webs are wound on core sleeves 1 that are held during the winding process at both ends by chucks 2 inserted in the core sleeve 1. Each chuck 2 is rotatably mounted on a winding arm 3. In order to carry out the winding procedure at least one of the chucks 2 is connected to a rotary drive for rotating the core sleeve 1. The rotary drive in the illustrated embodiment is an electric motor 4 that is mounted on one of the winding arms 3. The necessary torque is applied to the chuck 2 by means of the electric motor 4.

Roller-type slitting and winding machines have to be able to use core sleeves 1 of different inner diameters for the winding process. When the size of the core sleeve 1 is changed, the chucks 2 have to be exchanged for chucks 2 of the required outer diameter. It should be possible to exchange the chucks 2 quickly and without large effort, it being indispensable that exact centered rotation of the core sleeve 1 be ensured even at high processing speeds. Thus, according to the invention, a shaft 5 is fitted into a complementary central hole or bore 6 of the chuck 2 for rotatable mounting at each winding arm 3.

Figure 3:
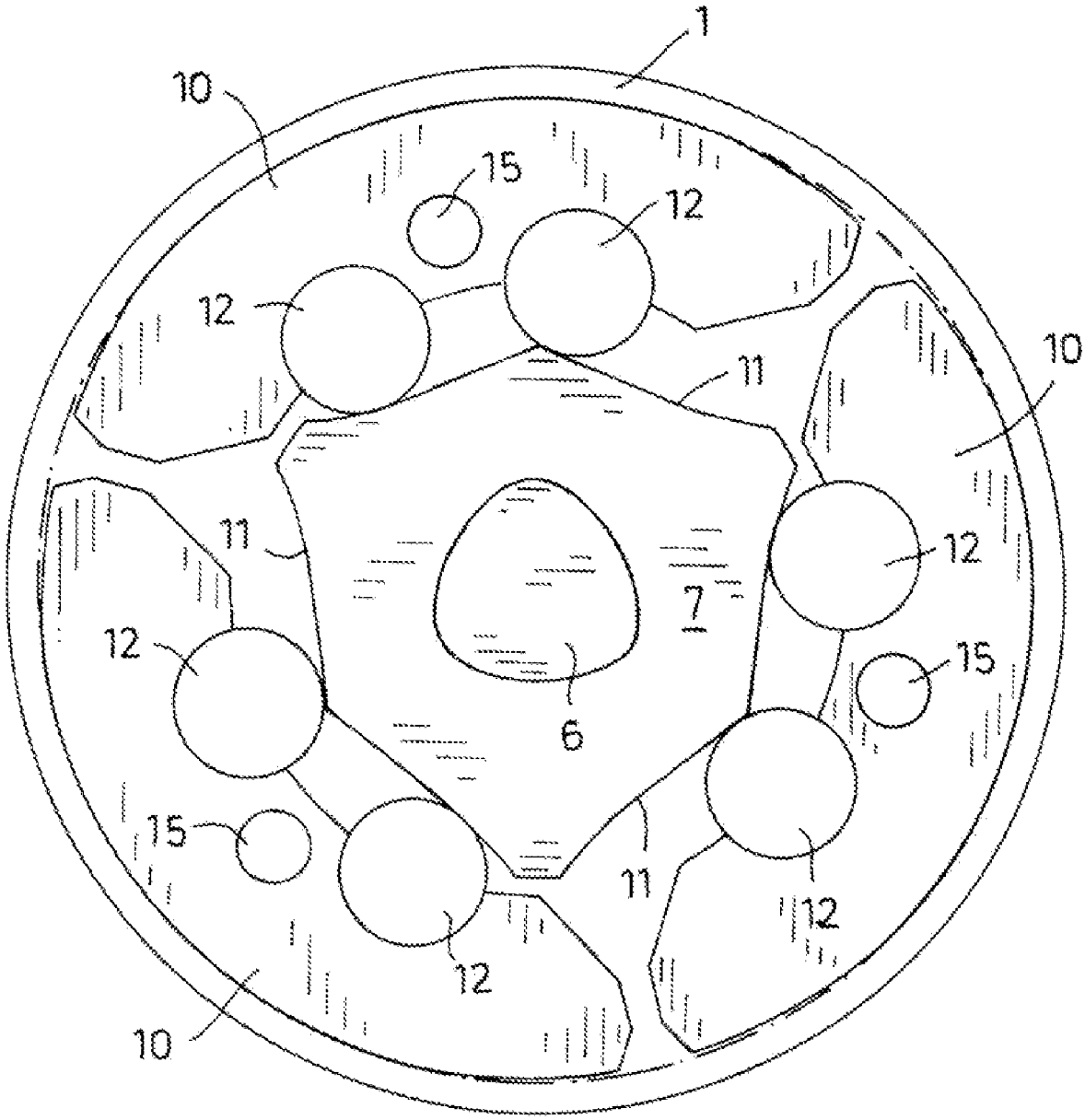
FIG. 3 shows a cross section in expanded condition, that is with the maximum chuck-jaw diameter.
Figure 4:
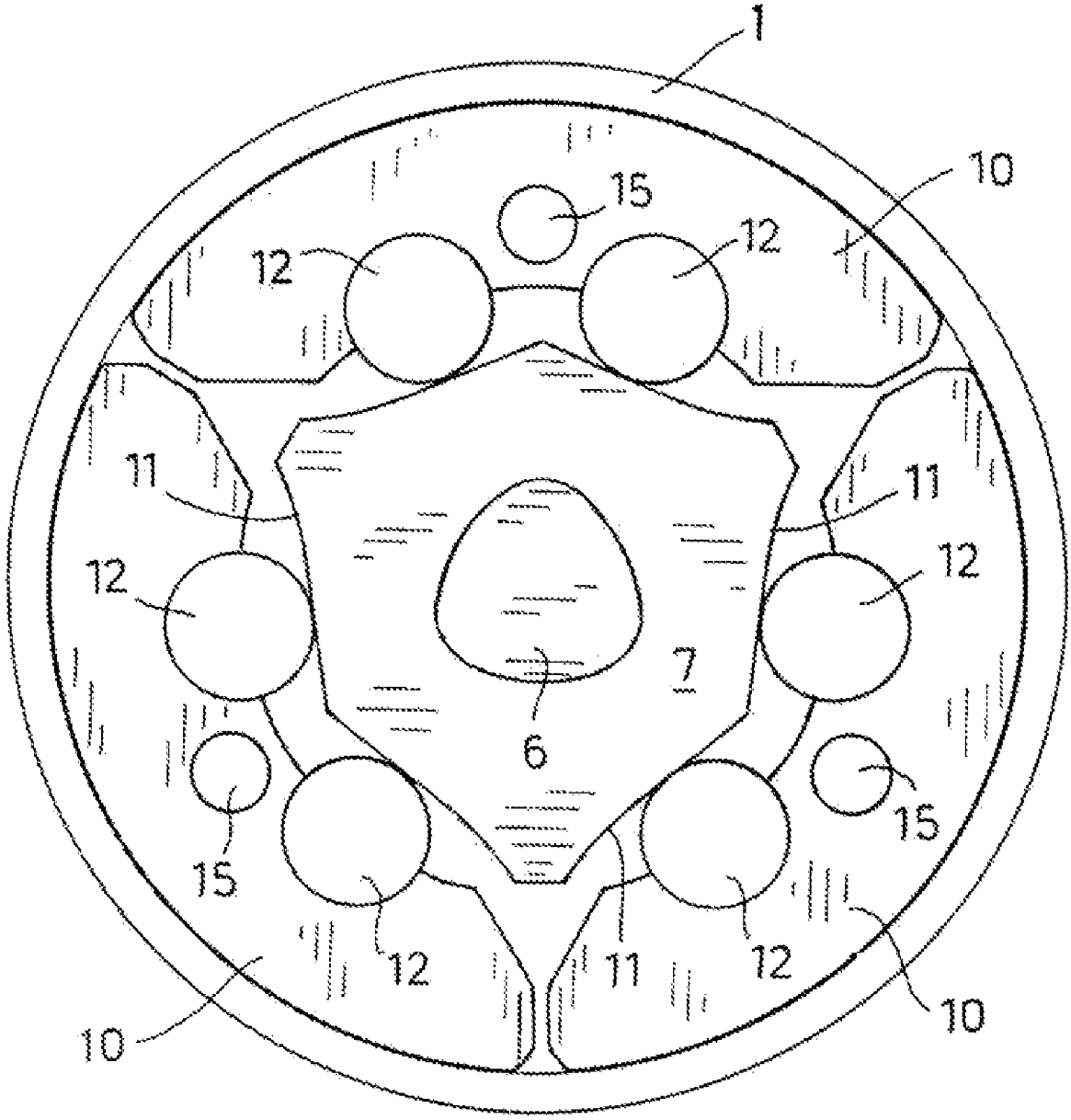
FIG. 4 shows a section in non-expanded condition, that is with the minimum chuck-jaw diameter.

As illustrated in FIG. 3, the hole 6 is situated in a central support hub 7. The hole 6 has a polygonal hub inner shape. The shaft 5 has a complementary polygonal outer shape. Such shapes are for example described in DIN 32 711. Preferably, polygonal shapes deriving from an equilateral triangle are used. The polygonal connection according to the invention has several advantages:

On the one hand, when no torque is applied there is a small amount of clearance between the shaft 5 and the support hub 7, so that when no torque is applied, the chuck 2 can be easily pulled off and slid onto the shaft 5. When torque is applied, the clearance between the support hub 7 and the shaft 5 is taken up by a slight turning movement such that the chuck 2 is perfectly centered on the shaft 5. The chuck 2 is secured to the shaft 5 by means of a central retaining screw 8 that to start with projects outward through a throughgoing hole in the support hub 7, and then extends through the polygonal hole 6, and finally is screwed into a threaded hole 9 formed in the center of the shaft 5. By means of the retaining screw 8 the chuck 2 can be easily detached from the shaft 5, as the retaining screw 8 can push the chuck 2 axially off the shaft 5. At the same time, the retaining screw 8 secures the chuck 2 on the shaft 5 axially.

The chuck 2 is a so-called expansion chuck whose outer surface is formed by a plurality of chuck jaws 10 formed as tube segments that are mounted so they can be radially shifted. Preferably, three chuck jaws 10 are circumferentially provided around the support hub 7. In order to radially shift the chuck jaws 10 when they are moved angularly relative to the support hub 7, the support hub 7 has for example six concavely curved outer faces 11 on which the chuck jaws 10 are supported. Preferably the chuck jaws 10 are supported by support elements that glide or roll on the outer faces 11. Preferably, cylindrical rollers 12 are mounted at the inner side of each chuck jaw 10 such that they project radially inward. The pairs of cylindrical rollers 12 respectively glide or roll on respective concave outer faces 11 and, while supporting a respective chuck jaw 10, change their distance from each other and thus also the distance between the chuck jaws 10 and a center of rotation 13 of the chuck 2. In the illustrated embodiment, the cylindrical rollers 12 are rotatably mounted in the chuck jaws 11. Preferably each chuck jaw 10 has two cylindrical rollers 12 that are spaced from each other and that can each move circumferentially on a respective one of the outer faces 11. The curves of the outer faces 11 are to this end designed such that when the support hub 7 carries out a relative rotation, all the chuck jaws 10 move radially through the same distance.

Each chuck 2 has on its outer side facing the winding arm 3 a flanged end plate 14 that is limitedly angularly movable on the support hub 7 and that is angularly connected to the respective chuck jaw 10. The angular connection in the illustrated embodiment is effected by a slide pin 15 that projects into a guide such that radial movement, but no angular movement of the chuck jaw 10 is possible. Alternatively the chuck jaws 10 themselves, or at least one cylindrical roller 12 per chuck jaw 10 can be extended and project with their ends into a slide-pin guide on the inner face of the end plate 14 in order to prevent relative angular movement. The angular connection between the end plate 14 and the chuck jaws 10 results in the radial expansion of the end plate and the chuck jaws, when a core sleeve 1 abuts the end plate 14 and turns it. It is therefore not necessary that the chuck jaws 10 abut the inner side of the core sleeve 1 when rotation starts for the radial expansion of the chuck jaws 10.

On its inner side, the chuck 2 is closed by a cover disk 16 that is secured to the support hub 7 by means of screws 17. A throughgoing hole 18 is formed in the center of the cover disk 16, through which a tool for tightening and detaching the retaining screw 8 can pass.

The invention provides the immense advantage that chucks 2 of different diameters and of different insertion depths, which means chucks 2 of different sizes for different core sleeves can be easily mounted on the shafts 5. To that end, the different chucks 2 all have the same polygonal hole 6 to ensure that they can be fastened to the same shaft 5. Therefore, a uniform polygonal connection between support hub 7 at the shaft 5 mounted on the winding arm 3 is used for all chucks 2.

The invention claimed is:

1. A core chuck for a web-winding machine, the core chuck comprising:

a drive shaft extending along an axis and having an outer periphery of polygonal shape seen axially;

a hub having a central hole with a polygonal shape substantially complementary to the shaft and fittable with limited clearance over the shaft, whereby the shaft and hub can move angularly limitedly relative to each other;

a plurality of outwardly directed faces on the hub;

respective jaws bearing on the faces, the faces being angled such that relative rotation between the hub and the jaws radially displaces the jaws;

a retaining screw extending along an axis of rotation of the shaft through the hub and having a threaded shank seatable in the shaft and a head engageable axially in one direction with the hub, whereby the screw can axially retain the hub on the shaft; and a cover disk axially fixed on the hub and formed on the axis with a hole of smaller diameter than the head of the screw, the screw head being captured axially between the disk and the hub, whereby when the screw is unscrewed from the shaft its head bears on the cover disk and pushes the hub off the shaft.

* * * * *